US010118799B2

(12) United States Patent
Piech

(10) Patent No.: US 10,118,799 B2
(45) Date of Patent: Nov. 6, 2018

(54) MULTICAR SELF-PROPELLED ELEVATOR SYSTEM

(71) Applicant: OTIS ELEVATOR COMPANY, Farmington, CT (US)

(72) Inventor: Zbigniew Piech, Cheshire, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 14/780,023

(22) PCT Filed: Mar. 25, 2013

(86) PCT No.: PCT/US2013/033645

§ 371 (c)(1),
(2) Date: Sep. 25, 2015

(87) PCT Pub. No.: WO2014/158127

PCT Pub. Date: Oct. 2, 2014

(65) Prior Publication Data

US 2016/0046464 A1 Feb. 18, 2016

(51) Int. Cl.
*B66B 9/00* (2006.01)
*B66B 11/04* (2006.01)

(52) U.S. Cl.
CPC ..... *B66B 9/003* (2013.01); *B66B 11/0407* (2013.01)

(58) Field of Classification Search
CPC ..... B66B 9/003; B66B 11/0407
USPC ..... 187/249
See application file for complete search history.

(56) References Cited

U.S. PATENT DOCUMENTS 3,658,155 A * 4/1972 Salter ..... B66B 9/00 187/270
5,174,416 A * 12/1992 Sakabe ..... B66B 11/0407 104/292
5,197,570 A * 3/1993 Matsui ..... B66B 9/003 187/249
5,235,144 A * 8/1993 Matsui ..... B66B 9/003 187/250

(Continued)

FOREIGN PATENT DOCUMENTS

CN 1868849 A 11/2006
CN 101875465 A 11/2010

(Continued)

OTHER PUBLICATIONS

Chinese Office Action and Search report for application 201380076875.3, dated Oct. 17, 2016 , 9 pages.

(Continued)

*Primary Examiner* — Michael A Riegelman
(74) *Attorney, Agent, or Firm* — Cantor Colburn LLP

(57) ABSTRACT

An elevator system includes a first hoistway; a second hoistway; and a structural member disposed between the first hoistway and the second hoistway; the structural member supporting a first stationary portion of a propulsion system for the first hoistway; the structural member supporting a first guide surface for an elevator car in the first hoistway; the structural member supporting a second stationary portion of the propulsion system for the second hoistway; the structural member supporting a second guide surface for an elevator car in the second hoistway.

9 Claims, 8 Drawing Sheets

(56) References Cited

U.S. PATENT DOCUMENTS 5,235,145 A * 8/1993 Olsen ..... H02K 41/025 187/250
5,288,956 A 2/1994 Kadokura et al.
5,547,059 A * 8/1996 Watanabe ..... B66B 5/18 187/288
5,651,426 A * 7/1997 Bittar ..... B66B 1/2458 187/249
5,717,261 A * 2/1998 Tozoni ..... B60L 13/10 104/282
5,751,076 A * 5/1998 Zhou ..... B66B 11/0407 187/250
5,758,748 A * 6/1998 Barker ..... B66B 9/003 187/249
6,189,657 B1 * 2/2001 Jessenberger ..... B66B 11/0407 187/289
7,261,186 B2 * 8/2007 Deplazes ..... B60L 13/10 187/277
9,248,994 B2 * 2/2016 Grundmann ..... B66B 9/00
2003/0217893 A1 * 11/2003 Dunser ..... B66B 1/2466 187/249
2006/0016640 A1 * 1/2006 Duenser ..... B66B 1/2466 187/249
2007/0181374 A1 * 8/2007 Mueller ..... B66B 9/00 187/249
2009/0266648 A1 * 10/2009 Asensio Bazterra ... B66B 9/187 187/270
2013/0206514 A1 * 8/2013 Kim ..... B66B 9/025 187/240
2014/0190774 A1 * 7/2014 Hsu ..... B66B 11/0005 187/406
2016/0075534 A1 * 3/2016 Witczak ..... B66B 9/00 187/240
2016/0137459 A1 * 5/2016 Rodriguez ..... B66B 11/0407 187/250
2016/0297640 A1 * 10/2016 Witczak ..... B66B 1/2466
2016/0297646 A1 * 10/2016 Piech ..... B66B 11/04
2016/0297647 A1 * 10/2016 Tangudu ..... B66B 11/0407
2016/0297648 A1 * 10/2016 Witczak ..... B66B 11/04
2016/0304316 A1 * 10/2016 Witczak ..... B66B 11/0407
2016/0304317 A1 * 10/2016 Witczak ..... B66B 11/04

FOREIGN PATENT DOCUMENTS

CN 102153008 * 8/2011
EP 0471464 A2 2/1992
JP 2875112 * 9/1992 ..... B66B 9/02
JP 06100272 A 4/1994
JP H07157239 A 6/1995
KR 200345050 Y1 3/2004
WO 2011140887 A1 11/2011
WO 2012038760 A2 3/2012

OTHER PUBLICATIONS

European Search Report for application EP 13880154.3, dated Oct. 4, 2016, 10 pages.
International Search Report for application PCT/US2013/033645, dated Dec. 27, 2013, 5 pages.
Written Opinion for application PCT/US2013/033645, dated Dec. 27, 2013, 6 pages.
J.F. Gieras, Z. J. Piech and B. Z. Tomczuk, "Linear Synchronous Motors, Transportation and Automation Systems", 2nd edition, University of Technology, Opole, Poland, chapter 9, CRC Press 2011, 30 pages.
Chinese First Office Action and Search Report for application 201380076875.3, dated Oct. 17, 2016, 9 pages.

* cited by examiner

MULTICAR SELF-PROPELLED ELEVATOR SYSTEM

FIELD OF INVENTION

The subject matter disclosed herein relates generally to the field of elevators, and more particularly to a multicar, self-propelled elevator system.

BACKGROUND

Self-propelled elevator systems, also referred to as ropeless elevator systems, are useful in certain applications (e.g., high rise buildings) where the mass of the ropes for a roped system is prohibitive and there is a desire for multiple elevator cars in a single hoistway. There exist self-propelled elevator systems in which a first hoistway is designated for upward traveling elevator cars and a second hoistway is designated for downward traveling elevator cars. A transfer station at each end of the hoistway is used to move cars horizontally between the first hoistway and second hoistway.

BRIEF SUMMARY

According to an exemplary embodiment of the invention, an elevator system includes a first hoistway; a second hoistway; and a structural member disposed between the first hoistway and the second hoistway; the structural member supporting a first stationary portion of a propulsion system for the first hoistway; the structural member supporting a first guide surface for an elevator car in the first hoistway; the structural member supporting a second stationary portion of the propulsion system for the second hoistway; the structural member supporting a second guide surface for an elevator car in the second hoistway.

According to another exemplary embodiment of the invention, an elevator system includes a first hoistway; a second hoistway; a first stationary portion of a propulsion system positioned in the first hoistway; a second stationary portion of the propulsion system positioned in the first hoistway; a first guide element for guiding an elevator car, the first guide element positioned in the first hoistway; a second guide element for guiding an elevator car, the second guide element positioned in the first hoistway.

Other aspects, features, and techniques of embodiments of the invention will become more apparent from the following description taken in conjunction with the drawings.

BRIEF DESCRIPTION OF THE DRAWINGS

Referring now to the drawings wherein like elements are numbered alike in the FIGURES.

DETAILED DESCRIPTION

Figure 1:
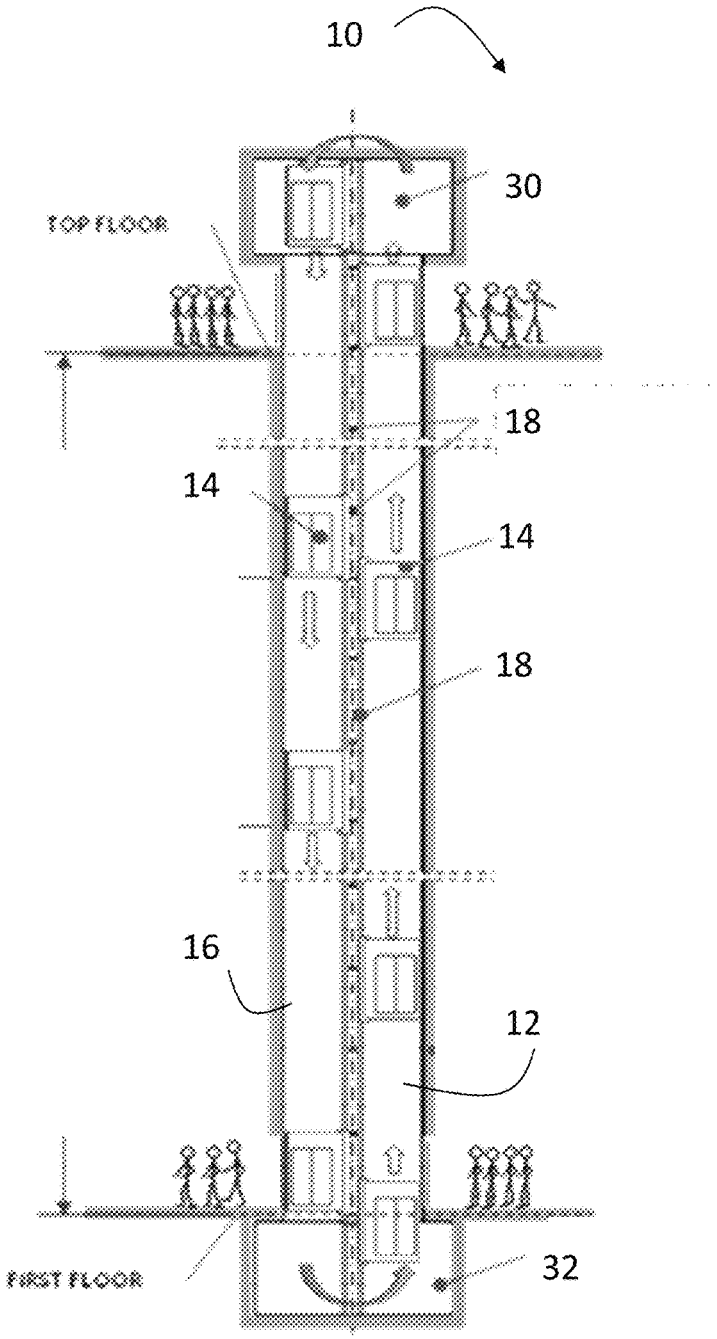
FIG. 1 depicts an elevator system in an exemplary embodiment.

FIG. 1 depicts an elevator system 10 in an exemplary embodiment. Elevator system 10 includes a first hoistway 12 in which elevators cars 14 travel upward. Elevator system 10 includes a second hoistway 16 in which elevators cars 14 travel downward. A structural member 18 is positioned between the first hoistway 12 and the second hoistway 16 and provides multiple functions. The structural member 18 supports a stationary portion of a propulsion system for the first hoistway 12 and the second hoistway 16. Structural member 18 also provides guide surfaces for elevator cars 14 in first hoistway 12 and elevator cars 14 in second hoistway 16, as described in further detail herein.

Elevator system 10 transports elevators cars 14 from a first floor to a top floor in first hoistway 12 and transports elevators cars 14 from the top floor to the first floor in second hoistway 16. Above the top floor is an upper transfer station 30 to impart horizontal motion to elevator cars 14 to move elevator cars 14 from the first hoistway 12 to the second hoistway 16. It is understood that upper transfer station 30 may be located at the top floor, rather than above the top floor. Below the first floor is a lower transfer station 32 to impart horizontal motion to elevator cars 14 to move elevator cars 14 from the second hoistway 16 to the first hoistway 12. It is understood that lower transfer station 32 may be located at the first floor, rather than below the first floor. Although not shown in FIG. 1, elevator cars 14 may stop at intermediate floors to allow ingress to and egress from an elevator car intermediate the first floor and top floor.

Figure 2:
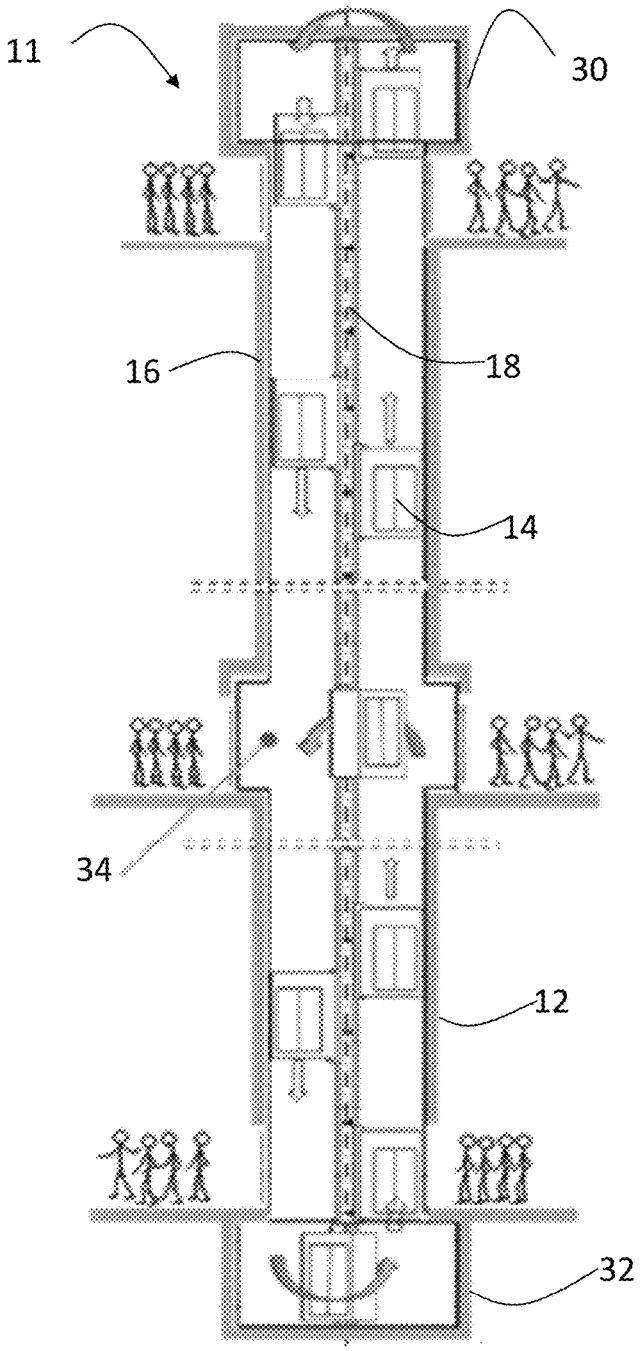
FIG. 2 depicts an elevator system in another exemplary embodiment.

FIG. 2 depicts an elevator system 11 in another exemplary embodiment. Elements of FIG. 2 corresponding to elements in FIG. 1 are labeled with the same reference numerals where practicable. Elevator system 11 includes an intermediate transfer station 34 located between the first floor and the top floor. Although a single intermediate transfer station 34 is shown it is understood that more than one intermediate transfer station 34 may be used. Intermediate transfer station 34 imparts horizontal motion to elevator cars 14 to move elevator cars 14 bidirectionally between the first hoistway 12 and second hoistway 16 to accommodate elevator car calls. For example, one or more passengers may be waiting for a downward traveling car at a landing of the intermediate transfer station 34. If no cars are available, an elevator car 14 may be moved from first hoistway 12 to second hoistway 16 at intermediate transfer station 34 and allow the passenger(s) to board. It is noted that elevator cars may be empty prior to transferring from one hoistway to another at any of upper transfer station 30, lower transfer station 32 and intermediate transfer station 34. Intermediate transfer station 34 may also be used in emergency situations, to route cars to passengers in need of transport.

Figure 3:
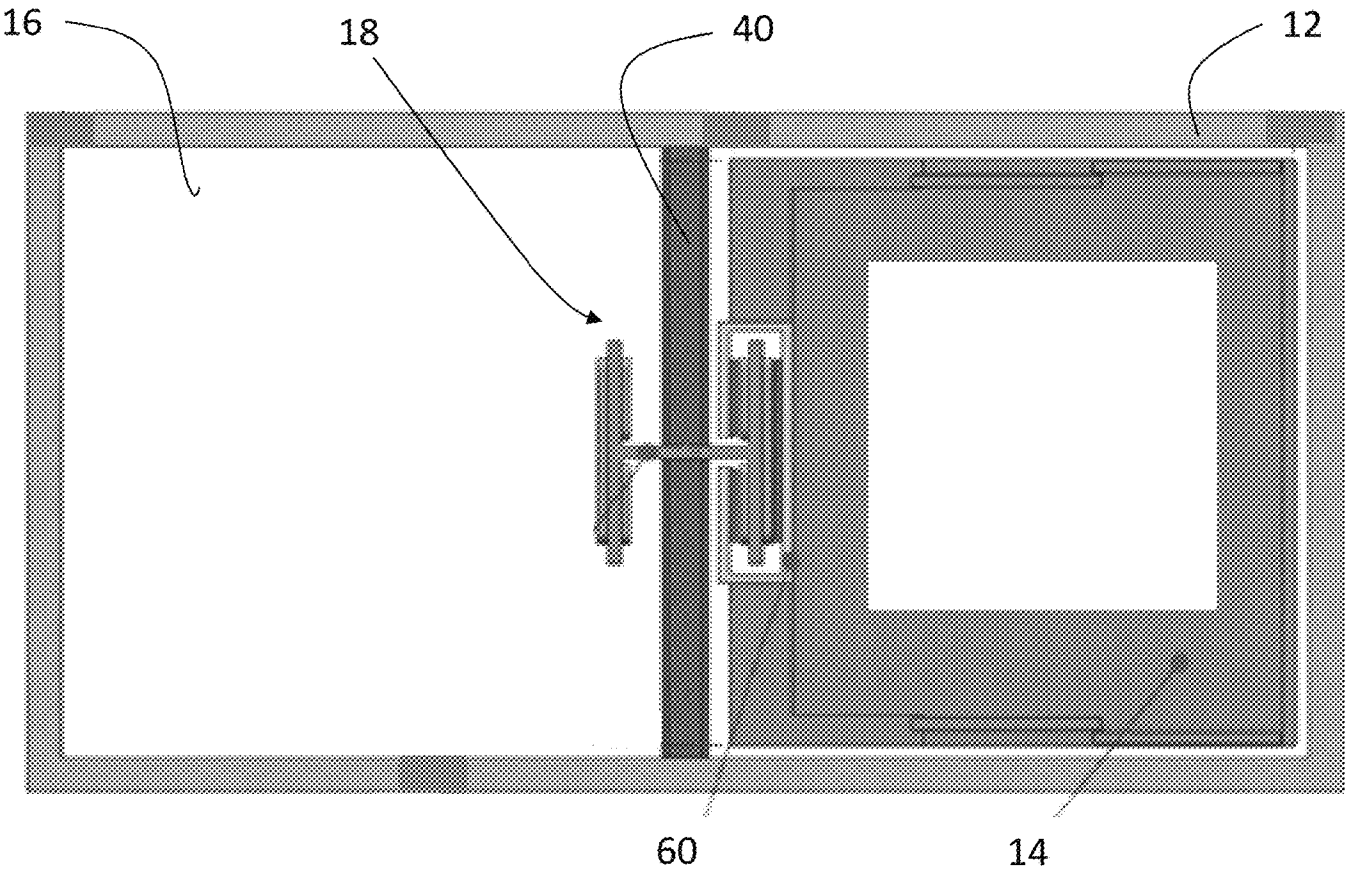
FIG. 3 is a top down view of an elevator car in a hoistway in an exemplary embodiment.

FIG. 3 is a top down view of an elevator car 14 in first hoistway 12 in an exemplary embodiment. As shown in FIG. 3, structural member 18 is positioned between the first hoistway 12 and second hoistway 16. Structural member 18 provides a mounting structure for a stationary portion of a propulsion system for first hoistway 12 and second hoistway 16. Support brackets 40 extend from structural member 18 and connect the structural member 18 to walls of hoistway 12 and/or hoistway 16. Also shown in FIG. 3 is a moving portion 60 of the propulsion system coupled to elevator car 14. The stationary portion and moving portion of the propulsion system are described in further detail herein.

Figure 4:
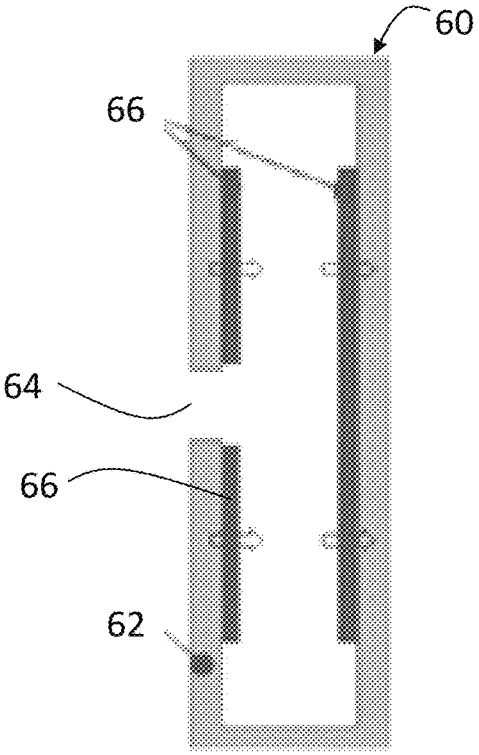
FIG. 4 is a top down view of a moving portion of a propulsion system in an exemplary embodiment.

FIG. 4 is a top down view of a moving portion 60 of a propulsion system in an exemplary embodiment. Moving portion 60 includes a support 62, which may be in the form of a generally rectangular channel. An opening 64 is provided in support 62 to receive the stationary portion of the propulsion system. Support 62 may be made from a ferromagnetic material. Mounted to at least one surface of support 62 is a secondary element 66 of the propulsion system. In the example shown in FIGS. 4 and 5, the propulsion system is a linear, permanent magnet motor. In this example, the secondary elements 66 are permanent magnets. In the example of FIG. 4, support 62 is formed as a channel, with permanent magnets 66 formed on opposite interior walls of the channel.

Figure 5:
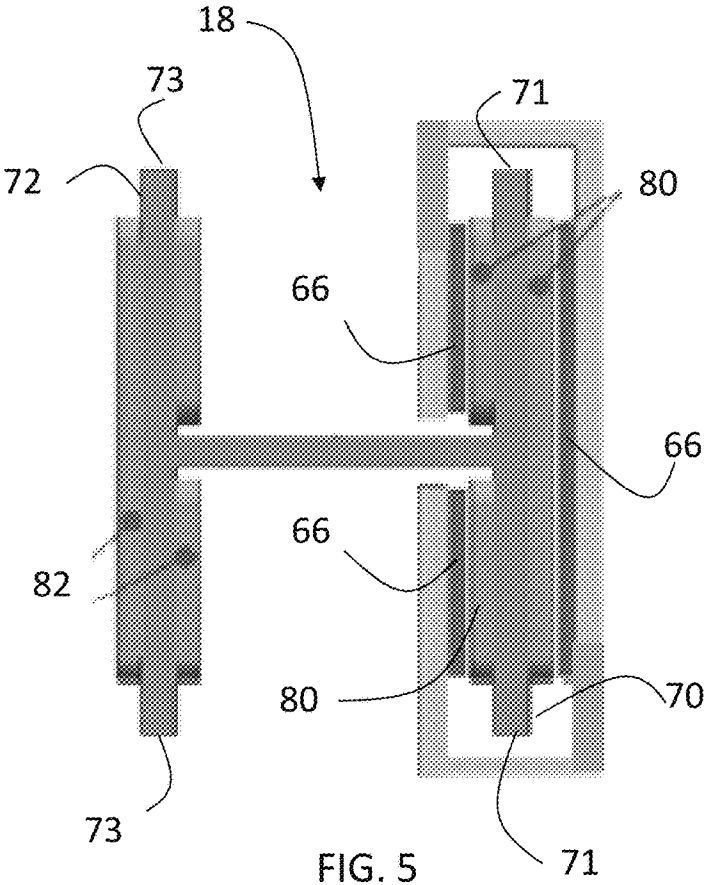
FIG. 5 is a top down view of a stationary portion and a moving portion of a propulsion system in an exemplary embodiment.

FIG. 5 is a top down view of a stationary portion and a moving portion of a propulsion system in an exemplary embodiment. Structural member 18 may be an H-shaped element made from a ferromagnetic material. Structural member 18 includes a first segment 70 located in first hoistway 12 and a second segment 72 located in the second hoistway 16. A primary element of the propulsion system is provided on first segment 70 and second segment 72. If the propulsion system is a linear permanent magnet motor, the primary segments include windings 80 formed on opposing sides of first segment 70 and windings 82 formed on opposing sides of second segment 72. As shown in FIG. 5, the first segment 70 and windings 80 are positioned within support 62, such that windings 80 and permanent magnets 66 are adjacent.

Windings 80 in first hoistway 12 are energized by a drive unit to propel one or more elevator cars 14 upward in first hoistway 12. As known in the art, when a voltage is applied to windings 80, the interaction between the windings 80 and permanent magnets 66 impart motion to elevator car 14. Windings 82 in second hoistway 16 operate as a regenerative brake to control descent of an elevator car 14 in second hoistway 16 and provide a current back to the drive unit, for example, to recharge an electrical system.

First segment 70 and second segment 72 include distal tips 71 and 73, respectively, that provide surfaces to receive guide rollers on elevator car 14. In alternate embodiments, tips 71 and 73 may be used as part of a main or auxiliary electro-magnetic, contact-less car guiding system. Tips 71 and 73 may also provide a surface upon which a brake, such as an emergency brake system, may apply pressure to hold an elevator car 14 in place.

Figure 6:
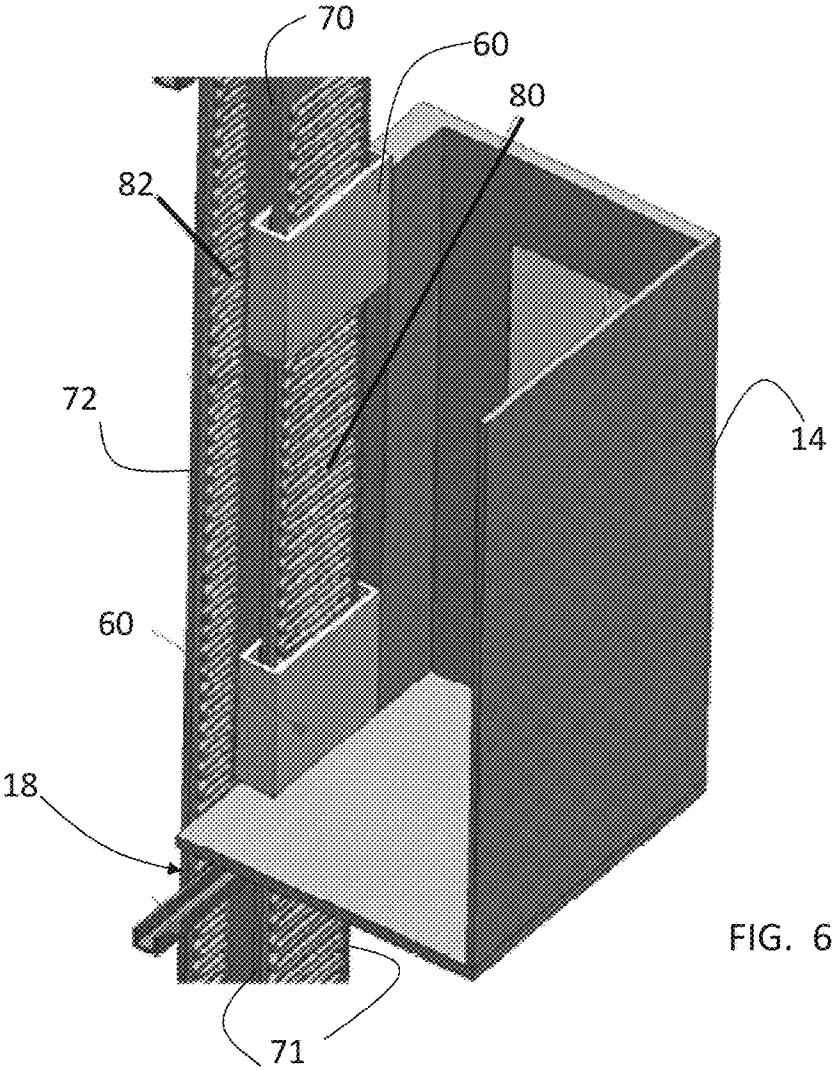
FIG. 6 is a perspective view of an elevator car and a propulsion system in an exemplary embodiment.

FIG. 6 is a perspective view of an elevator car 14 and a propulsion system in an exemplary embodiment. Moving portion 60 of the propulsion system may include multiple moving portions 60 coupled to elevator car 14. Using multiple moving portions 60 may improve guidance of the elevator car in hoistways 12 and 16. FIG. 6 depicts windings 80 on first segment 70 of structural member 18. Also shown are windings 82 on second segment 72 of structural member 18. Tips 71 of first segment 70 are used as guide rails for elevator car 14. Although the windings are shown located on structural member 18 and permanent magnets are mounted to car 14, it is understood that the locations of these elements may be reversed. In such embodiments, permanent magnets are stationary and extend along the structural member 18 and windings are mounted to elevator cars 14.

Figures 7, 8, 9:
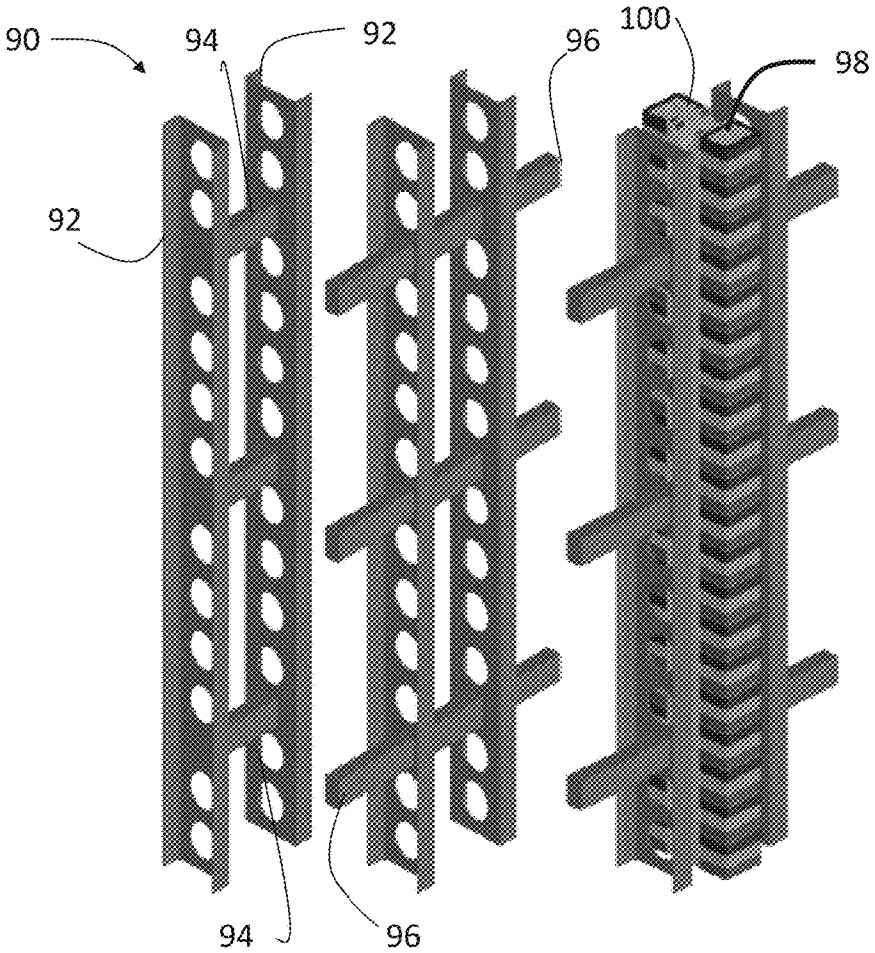
FIGS. 7-9 illustrate construction of a structural member and stationary portion of a propulsion system in an exemplary embodiment.

FIGS. 7-9 illustrate construction of a structural member and stationary portion of a propulsion system in an exemplary embodiment. Structural member 90 includes two beams 92. Beams 92 may be C-shaped to improve rigidity. Openings may also be formed in beams 92 to reduce weight. Beams 92 are joined by braces 94 along the length of beams 92. As shown in FIG. 8, support brackets 96 are attached to beams 92. Support brackets 96 may be aligned with braces 94. Support brackets 96 couple the structural member 90 to a wall of hoistway 12 or hoistway 16. FIG. 9 depicts the addition of windings 98 and 100 to structural member 90. Windings 98 provide a first stationary portion of the propulsion system for first hoistway 12. Windings 100 provide a second stationary portion of the propulsion system for second hoistway 16. Windings 98 and windings 100 may be formed about cores secured to structural member 90. Structural member 90, along with windings 98 and 100, may be formed and installed in a modular fashion. This allows the structural member 90 to be used in hoistways of varying lengths, without requiring a customized structural member.

Figure 10:
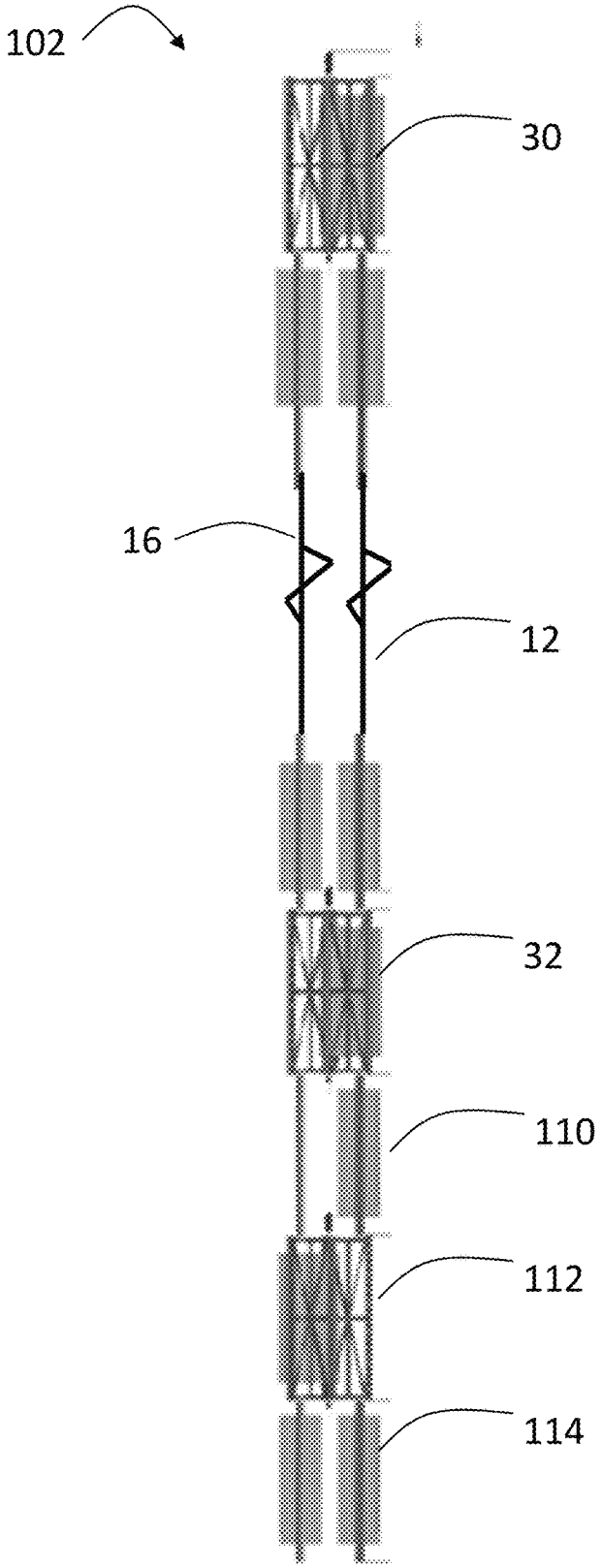
FIG. 10 depicts an elevator system in another exemplary embodiment.

FIG. 10 depicts an elevator system 102 in another exemplary embodiment. Elevator system 102 includes elements of elevator system 10, which are labeled with similar reference numerals. FIG. 10 depicts additional zones below the lower transfer station 32. A buffer zone 110 is provided below lower transfer station 32. Buffer zone 110 provides a space where cars can be transported to and from a service transfer station 112. Service transfer station 112 is located below the buffer zone 110 and provides a space where elevator cars 14 can be transferred bidirectionally between the first hoistway 12 and second hoistway 16 if needed for service. A service level 114 is positioned below the service transfer level 112 and provides an area for servicing elevator cars 14, including inspection, maintenance, storage, etc. Service level 114 may extend horizontally to store a plurality of elevator cars.

Figure 11:
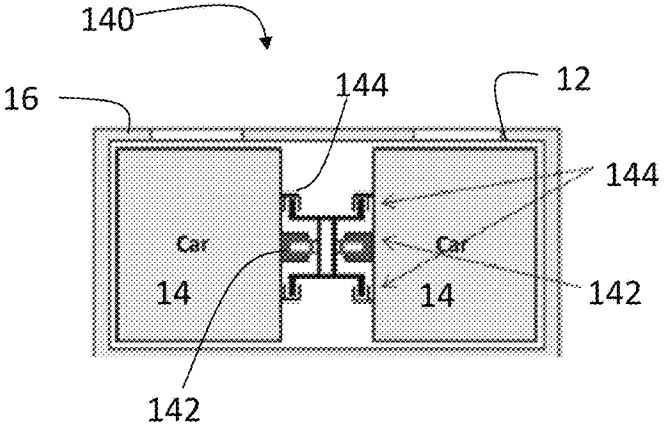
FIGS. 11-13 are top down views depicting propulsion systems and guide elements in exemplary embodiments.
Figure 12:
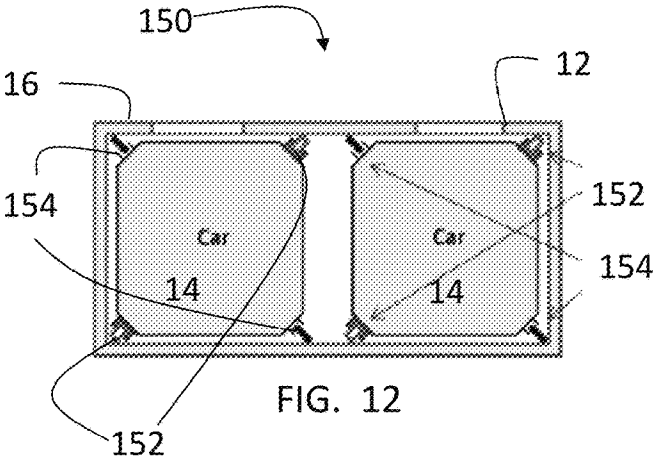
Figure 13:
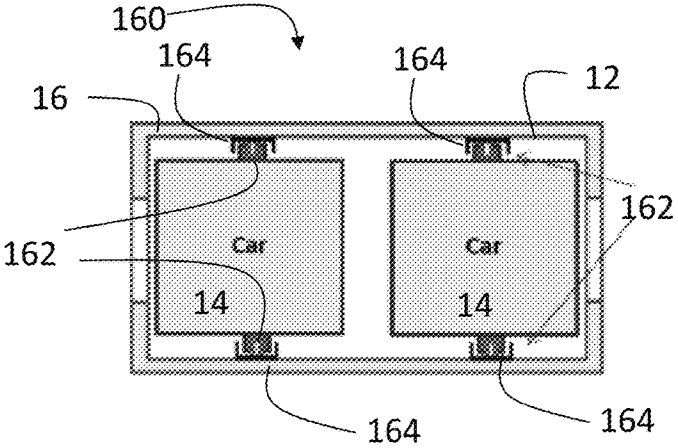

FIGS. 11-13 are top down views depicting propulsion systems and guide elements in exemplary embodiments. FIG. 11 depicts an elevator system 140 similar to that in FIG. 3, in which a central structural member provides both the stationary portion of the propulsion system for hoistways 12 and 16 and guide elements 144 for elevator cars 14. Guide elements 144 may include a guide surface of a structural member that coacts with a guide roller on car elevator 14. Cars 14 include a moving portion of the propulsion system as described above.

FIG. 12 depicts an elevator system 150 in an alternate embodiment. Elevator system 150 has two stationary portions 152 of the propulsion system for each hoistway 12 and 16 positioned in the hoistway at two diagonally opposite corners of each hoistway 12 and 16. Guide elements 154 are positioned in the hoistway at the remaining diagonally opposite corners of each hoistway. Guide elements 154 coact with guides on cars 14. Cars 14 include at least one moving portion of the propulsion system for each stationary portion of the propulsion system as described above.

FIG. 13 depicts an elevator system 160 in an alternate embodiment. Elevator system 160 has two stationary portions 162 of the propulsion system for each hoistway 12 and 16 positioned in the hoistway at two opposite sidewalls of each hoistway 12 and 16. Guide elements 164 are positioned in the hoistway and collocated with the stationary portions 162 of the propulsion system at the opposite sidewalls of each hoistway 12 and 16. Guide elements 164 coact with guides on cars 14. Cars 14 include at least one moving portion of the propulsion system for each stationary portion of the propulsion system as described above.

Embodiments increase capacity (passenger per hour) of vertical transportation in tall and mega tall buildings as well as decrease floor area occupied by the elevator system. Embodiments improve performance by increasing traffic density (e.g., more than doubling the number of passengers per minute delivered to the top floor comparing to double deck rope shuttle elevator system). Embodiments reduce surface area on each floor occupied by the vertical transportation system in the building which leads to increased utilization of building space for customer. Embodiments provide easier and reduced cost of maintenance. There is no periodic replacement of the ropes. Maintenance and inspection of an individual car does not require shutting down whole elevator system. Embodiments provide modularity with a one-time development investment. A system designed and developed one time can be (and should be) applicable to different buildings with a wide range of rise (e.g., a taller building will require a larger number of the same modules than a shorter building). Embodiments eliminate the use of heavy installation equipment as there will be no need for a costly lifting crane mounted in the building core to lift heavy machine(s). Embodiments also eliminate the need for ropes installation as well as the use of heavy, double-deck car construction with safeties. Embodiments provide system flexibility and adaptability to the actual needs of traffic. Car profiles, destinations, commissioning, decommissioning, periodic breaks for maintenance and inspection are controlled independently and with coordination of the functioning of whole system.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as being limited by the foregoing description, but is only limited by the scope of the appended claims.

The invention claimed is:

1. An elevator system comprising:

a first hoistway;

a second hoistway;

a first stationary portion of a propulsion system positioned in the first hoistway;

a second stationary portion of the propulsion system positioned in the first hoistway;

a first guide element for guiding an elevator car, the first guide element positioned in the first hoistway;

a second guide element for guiding the elevator car, the second guide element positioned in the first hoistway;

wherein the first stationary portion of the propulsion system is positioned on a first wall of the first hoistway, the second stationary portion of the propulsion system is positioned on a second wall of the first hoistway, the first wall and second wall being opposing walls of the hoistway;

wherein the first stationary portion of the propulsion system comprises a pair of beams having windings positioned between the beams, a plurality of openings formed in at least one of the beams, a plurality of braces connecting the pair of beams and a plurality of support brackets extending from each of the beams.

2. The elevator system of claim 1 further comprising:

a lower transfer station positioned at or below a first floor of the first hoistway and the second hoistway, the lower transfer station imparting horizontal motion to the elevator car to transfer the elevator car from the second hoistway to the first hoistway.

3. The elevator system of claim 2 further comprising:

an upper transfer station positioned at or above a top floor of the first hoistway and the second hoistway, the upper transfer station imparting horizontal motion to the elevator car to transfer the elevator car from the first hoistway to the second hoistway.

4. The elevator system of claim 3 further comprising:

at least one intermediate transfer station positioned between the lower transfer station and the upper transfer station, the at least one intermediate transfer station imparting horizontal motion to the elevator car to transfer the elevator car from the first hoistway to the second hoistway or transfer the elevator car from the second hoistway to the first hoistway.

5. The elevator system of claim 1 further comprising:

at least one transfer station to transfer the elevator car between the first and second hoistways.

6. The elevator system of claim 1 further comprising:

a moving portion of the propulsion system mounted to the elevator car;

the moving portion of the propulsion system configured to coact with the first stationary portion of the propulsion system when the elevator car is in the first hoistway;

wherein the moving portion of the propulsion system includes two moving portions of the propulsion system, the two moving portions of the propulsion system mounted to the elevator car.

7. The elevator system of claim 1 wherein:

the first stationary portion of the propulsion system and the second stationary portion of the propulsion system comprise modular segments.

8. The system of claim 1 wherein:

the first guide element is positioned on the first wall of the first hoistway and the second guide element is positioned on the second wall of the first hoistway.

9. The elevator system of claim 1 further comprising:

a third stationary portion of the propulsion system positioned in the second hoistway; and a fourth stationary portion of the propulsion system positioned in the second hoistway.

* * * * *